US005743757A

United States Patent [19]

Chen

[11] Patent Number: 5,743,757

[45] Date of Patent: Apr. 28, 1998

[54] LAMP SOCKET WITH WATER SEALING MEANS

[76] Inventor: Ming-Hsiung Chen, 7F, No. 16, Alley 3, Lane 227, Nung-An St., Taipei City, Taiwan

[21] Appl. No.: 638,495

[22] Filed: Apr. 26, 1996

Related U.S. Application Data

[63] Continuation-in-part of Ser. No. 546,820, Oct. 23, 1995.

[51] Int. Cl.[6] ..... H01R 4/24

[52] U.S. Cl. ..... 439/419; 200/51.09; 200/51.14; 439/277; 439/280; 439/414

[58] Field of Search ..... 439/188, 277, 439/280, 414, 419, 602; 200/51 R, 51.01, 51.09, 51.14

[56] References Cited

U.S. PATENT DOCUMENTS

| | | | |
|---|---|---|---|
| 2,170,317 | 8/1939 | Bussmann | 200/51.09 |
| 2,296,717 | 9/1942 | Kridler | 439/602 |
| 2,570,751 | 10/1951 | Benander | 439/419 |
| 3,128,141 | 4/1964 | Krupp et al. | 439/419 |
| 3,251,023 | 5/1966 | Schick | 439/414 |
| 3,660,801 | 5/1972 | Paulfus | 439/419 |
| 3,716,818 | 2/1973 | Finkelstein . | |
| 4,382,654 | 5/1983 | Schick . | |
| 4,653,829 | 3/1987 | LaMont . | |
| 4,660,916 | 4/1987 | Williams, Jr. . | |
| 5,228,774 | 7/1993 | Liao | 439/419 |
| 5,421,742 | 6/1995 | Huang | 439/419 |
| 5,446,640 | 8/1995 | Lin | 362/407 |
| 5,474,467 | 12/1995 | Chen | 439/419 |
| 5,492,483 | 2/1996 | Cheng et al. | 439/339 |
| 5,562,481 | 10/1996 | Myson | 439/419 |
| 5,573,419 | 11/1996 | Chen | 439/419 |

FOREIGN PATENT DOCUMENTS

| | | |
|---|---|---|
| 119539 | 10/1918 | United Kingdom . |
| 2253045 | 8/1992 | United Kingdom . |

*Primary Examiner*—J. J. Swann
*Attorney, Agent, or Firm*—Ladas & Parry

[57] ABSTRACT

A lamp socket in which a rubber water sealing cushion is mounted in a top recess at the center of the transversely grooved top wall of the socket body and covered around the electric wire to protect the positive metal contact plate against outside water, a rubber socket is mounted inside the socket body and covered around the positive metal contact plate, having an outward flange which is pressed on the base top of the lamp bulb and circularly covered over the tip contact thereof, and a metal strip transversely suspending on the inside and forced by the tip contact of the lamp bulb into contact with the positive metal contact plate.

5 Claims, 4 Drawing Sheets

LAMP SOCKET WITH WATER SEALING MEANS

This application is a continuation-in-part of Ser. No. 08/546,820, filed Oct. 23, 1995.

BACKGROUND OF THE INVENTION

The present invention relates to lamp sockets, and relates more particularly to a lamp socket with water sealing means which has a rubber water sealing cushion mounted in the transversely grooved top wall of the socket body and covered around the electric wire to protect the positive metal contact plate against outside water, and a rubber socket mounted inside the socket body around the positive metal contact plate to protect the tip contact of the lamp base against outside water and to protect direct contact of fingers to the positive metal contact plate.

According to American UL and Canada CSA specifications, the center metal contact plate which contacts the tip contact of the lamp bulb must be connected to the positive (hot) wire, and the side metal contact plate which contacts the ring contact of the lamp bulb must be connected to the negative (grounded) wire. Because the side metal contact plate is disposed adjacent to the opening of the socket body and tends to be touched by fingers, it must be connected to the negative wire to prevent an electric shock. However, when a lamp socket is installed outdoors and the lamp bulb is removed, children may insert fingers into the lamp socket to touch the center metal contact plate, causing an electric shock. Furthermore, few lamp sockets have water sealing means to seal the center metal contact plate against water. When a lamp socket is installed outdoors, rain water tends to pass to the inside of the lamp socket and to wet the center metal contact plate.

SUMMARY OF THE INVENTION

The present invention has been accomplished to provide a lamp socket which eliminates the aforesaid problems.

According to one aspect of the present invention, a rubber water sealing cushion is mounted in a top recess at the center of the transversely grooved top wall of the socket body and covered around the electric wire to protect the positive metal contact plate against outside water. According to another aspect of the present invention, a rubber socket is mounted inside the socket body and covered around the positive metal contact plate, having an outward flange which is pressed on the base top of the lamp bulb and circularly covered over the tip contact thereof, and a metal strip transversely suspending on the inside and forced by the tip contact of the lamp bulb into contact with the positive metal contact plate.

DETAILED DESCRIPTION OF THE PREFERRED EMBODIMENT

Figure 1:
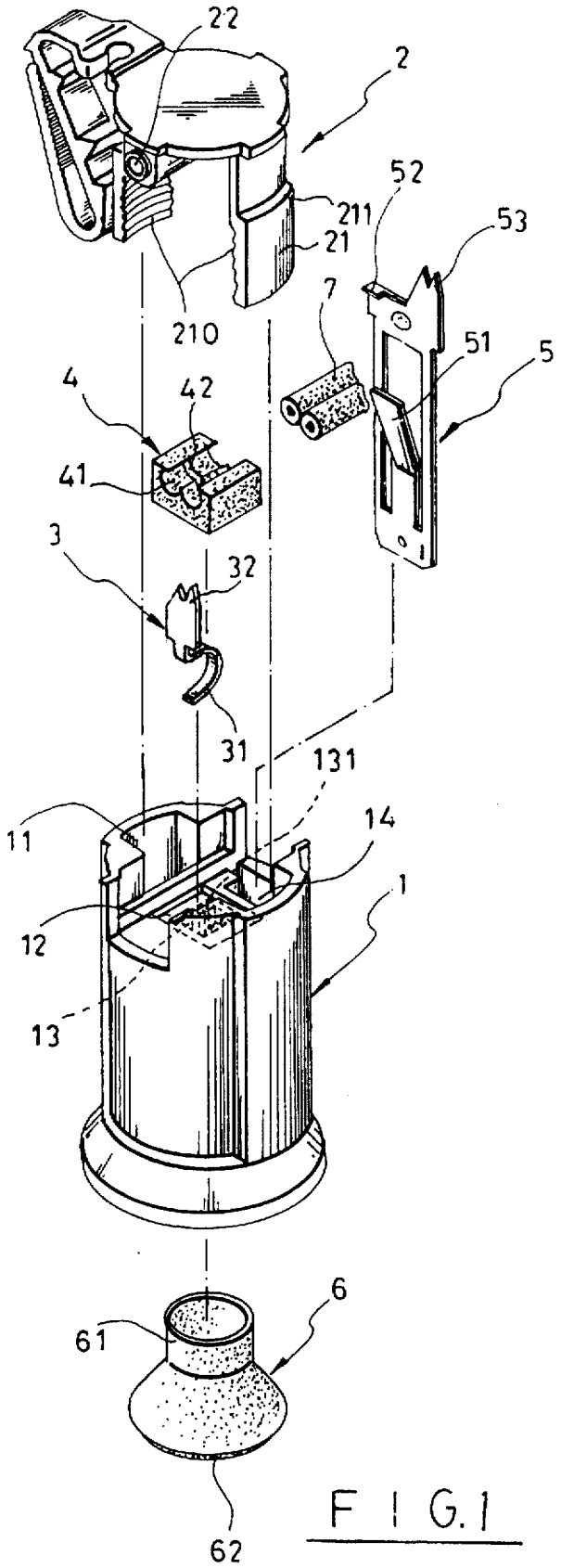
FIG. 1 is an exploded view of a lamp socket according to the present invention.

Referring to FIGS. 1, 2, 3, and 4, the socket body, referenced by 1, comprises two plug holes 11 in the transversely grooved top wall thereof at two opposite sides, a top recess 12 at the center of the transversely grooved top wall, a first vertical through hole 13 through the center of the top recess 12, two vertical mounting grooves 131 inside the first vertical through hole 13 at two opposite locations, a second vertical through hole 14 through the transversely grooved top wall near the border, and an inside annular groove 15 on the inside around the first vertical through hole 13. A positive metal contact plate 3 is mounted in the vertical mounting grooves 131 in the center through hole 13, having a pointed upright tip 32 at the top which is forced into the insulator of the electric wire, referenced by 7, to make contact with the positive wire therein, and a curved spring contact portion 31 at the bottom which suspends inside the socket body 1. A negative metal contact plate 5 is mounted in the second vertical through hole 14, having a projecting strip 51 obliquely upwardly raised from one side thereof and suspending inside the socket body 1, an angled stop portion 52 at the top stopped above the second vertical through hole 14, and a pointed upright tip 53 which pierces the insulator of the electric wire 7 to make contact with the negative wire therein. A socket cap 2 is fastened to the socket body 1 to hold down the electric wire 7 in the transversely grooved top wall of the socket body 1. As illustrated, the socket cap 2 comprises a bottom pressure block 22 in the middle pressed on the electric wire 7, two downward plugs 21 at two opposite sides respectively fastened to the plug holes 11 of the socket body 1. Each of the downward plugs 21 has a step 211 at an outer side forced into engagement with a respective projecting block (not shown) inside the socket body 1, and a threaded portion 210 at an inner side for engaging the ring contact of the base of the lamp bulb 8 which is threaded into the socket body 1.

Figure 5:
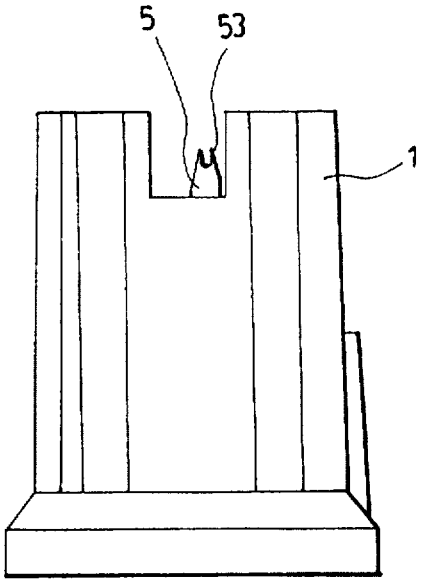
FIG. 5 is a plan view of the socket body before the installation of the water sealing cushion and the electric wire.
Figure 6:
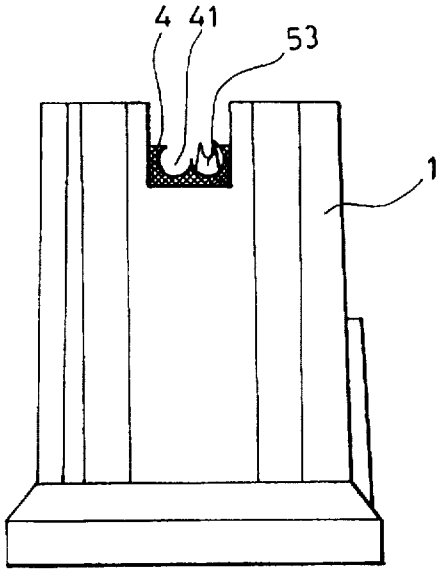
FIG. 6 is another plan view of the socket body, showing the water sealing cushion installed.
Figure 7:
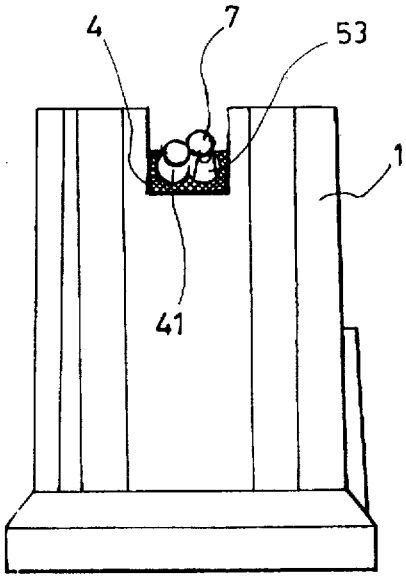
FIG. 7 is still another plan view of the socket body, showing the water sealing cushion and the electric wire installed.
Figure 8:
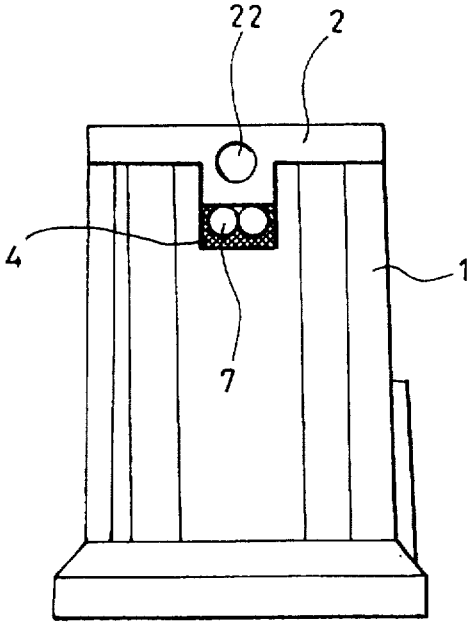
FIG. 8 is still another plan view of the socket body, showing the water sealing cushion, the electric wire, and the socket cap installed.

Referring to Figures from 5 to 8 and FIG. 1 again, a rubber water sealing cushion 4 is provided having a transverse top groove 41 and a vertical through hole 42 through the transverse top groove 41. When the positive metal contact plate 3 is installed in the first vertical through hole 13 of the socket body 1 (see FIGS. 1 and 5), the rubber water sealing cushion 4 is mounted within the top recess 12 of the socket body 1, permitting the pointed upright tip 32 of the positive metal contact plate 3 to pass through the vertical through hole 42 (see FIG. 6), then the electric wire 7 is mounted in the transverse top groove 41 of the rubber water sealing cushion 4 (see FIG. 7), and then the downward plugs 21 of the socket cap 2 are respectively fastened to the plug holes 11 of the socket body 1, thereby causing the bottom pressure block 22 to hold down the electric wire 7 in the rubber water sealing cushion 4 (see FIG. 8) and to force the electric wire 7 into contact with the pointed upright tip 32 of the positive metal contact plate 3 and the pointed upright tip 53 of the negative metal contact plate 5 respectively. After the installation of the socket cap 2, a rubber socket 6 is mounted inside the socket body 1. The rubber socket 6 comprises a tubular top mounting neck 61 fastened to the inside annular groove 15 of the socket body 1, an outward flange 62, and a metal strip 63 transversely mounted within the tubular top mounting neck 61.

Figure 2:
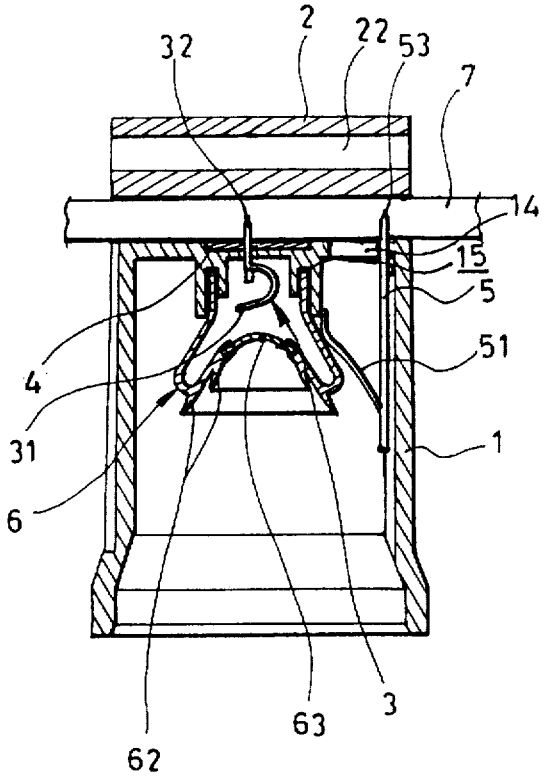
FIG. 2 is a sectional assembly view of the lamp socket shown in FIG. 1 (before the installation of the lamp bulb)
Figure 3:
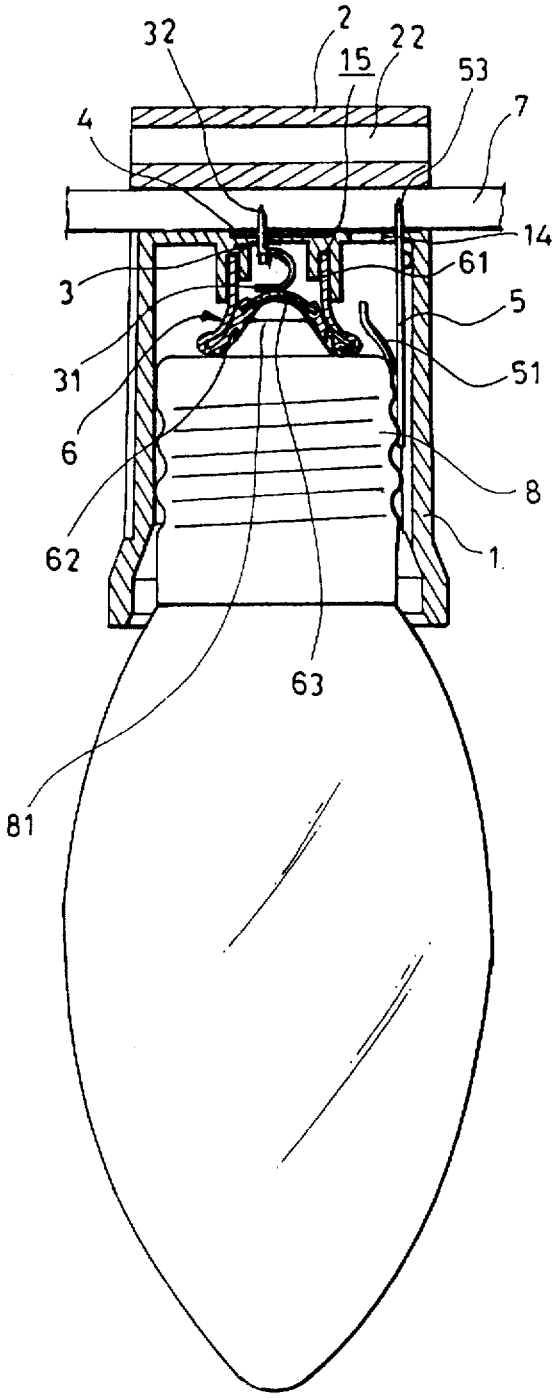
FIG. 3 is similar to FIG. 2 but showing the lamp bulb installed.
Figure 4:
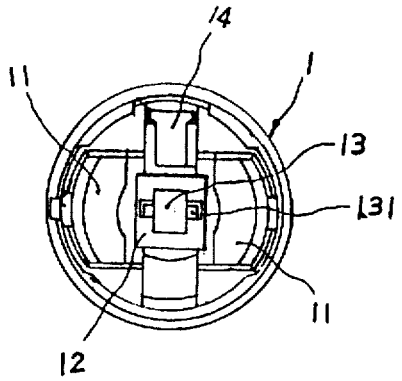
FIG. 4 is a top plan view of the lamp socket shown in FIG. 1.

Referring to FIGS. 2 and 3, when the base of the lamp bulb 8 is threaded into the socket body 1 to force the ring contact into contact with the projecting strip 51 of the negative metal contact plate 5, the tip contact 81 of the lamp bulb 8 is inserted into the rubber socket 6 and circularly covered by the outward flange 62, and the metal strip 63 of the rubber socket 6 is forced upwards by the tip contact 81 of the lamp bulb 8 into contact with the curved spring contact portion 31 of the positive metal contact plate 3. When the lamp bulb 8 is disconnected from the socket body 1, the rubber socket 6 immediately returns to its former shape, therefore the metal strip 63 is moved away from the curved spring contact portion 31 of the positive metal contact plate 3. Because the rubber socket 6 is mounted inside the socket body 1 and spaced below the positive metal contact plate 3, the positive metal contact plate 3 will not be directly touched when one inserts the finger into the socket body 1. Because the outward flange 62 of the rubber socket 6 is circularly covered over the tip contact 81 of the lamp bulb 8, the tip contact 81 of the lamp bulb 8 is protected against outside water. Furthermore, the rubber water sealing cushion 4 and the rubber socket 6 seals the positive metal contact plate 3 against outside water.

What the invention claimed is:

1. A lamp socket comprising:

a socket body having a top transversely grooved top wall having a center vertical through hole, a side vertical through hole, and a central top recess formed in said socket body, the top wall further having an inside annular groove formed within the socket body and around the center vertical through hole;

a first contact plate mounted within the center vertical through hole, said first contact plate having a pointed tip;

a second contact plate mounted within the side vertical through hole;

an electric wire fastened to the transversely grooved top wall of the socket body;

a socket cap fastened to the socket body to hold down the electric wire and to force the electric wire into contact with the first contact plate and the second contact plate;

a water sealing cushion mounted within the central top recess of the socket body and disposed about the electric wire, the water sealing cushion having a vertical through hole formed therein, the vertical through hole receiving the pointed tip of the first contact plate, the pointed tip making electrical contact with the electric wire, the water sealing cushion preventing the exposure of the electrical contact to fluids;

a flexible inner socket fastened to the inside annular groove of the socket body, the inner socket having a metal strip retained therein and further having an outward flange disposed opposite the inside annular groove of the socket body;

the outward flange of the inner socket being pressed against a base of a lamp bulb when the lamp bulb is inserted into the socket body, thereby effecting a water-tight seal of a tip contact of the lamp bulb, the tip contact contacting and pressing the metal strip of the inner socket against the first contact plate as the bulb is inserted into the socket body, thereby creating an electrical contact between the tip contact of the bulb and the first contact when the bulb is inserted into the socket body.

2. A lamp socket for receiving a lamp having a tip contact, the lamp socket comprising:

a socket body;

a contact mounted within the socket body, the contact having a contact portion for making an electrically conductive connection with the tip contact of the lamp when the lamp is received in the socket body; and a flexible inner socket surrounding and covering the contact portion of the contact, at least a portion of the flexible inner socket being made of an electrically conductive material, the electrically conductive material of the flexible inner socket being spaced from the contact portion of the contact when no lamp is received within the socket body and the flexible inner socket assuming a deformed configuration in response to the lamp being received within the socket body while the tip of the lamp bears against the electrically conductive material of the flexible inner socket to urge the electrically conductive material of the flexible inner socket into contact with the contact portion of the contact to create the electrically conductive connection between the tip contact of the lamp and the contact portion of the contact when the lamp is received in the socket body.

3. The lamp socket of claim 2, further comprising:

a wire in electrical connection with the contact;

a water sealing cushion mounted on the socket body and disposed about the wire to inhibit exposure of the electrical connection between the contact and the wire to fluids.

4. The lamp socket of claim 2, wherein:

the flexible inner socket has an outward flange disposed about the tip contact of the lamp when the lamp is received in the socket body to effect a water-tight seal between the flexible inner socket and the tip contact of the lamp bulb.

5. The lamp socket of claim 2, wherein:

the electrically conductive material of the flexible inner socket is a metal strip retained within the flexible inner socket.

* * * * *